US010196588B2

(12) United States Patent
Raja Abdul Rahman et al.

(10) Patent No.: US 10,196,588 B2
(45) Date of Patent: Feb. 5, 2019

(54) DETERGENT FORMULATION FOR DISHWASHING MACHINE

(71) Applicant: Universiti Putra Malaysia (UPM), Serdang, Selangor (MY)

(72) Inventors: Raja Noor Zaliha Raja Abdul Rahman, Serdang (MY); Abu Bakar Salleh, Serdang (MY); Mahiran Basri, Serdang (MY); Izuddin Abdul Rahman, Serdang (MY)

(73) Assignee: UNIVERSITI PUTRA MALAYSIA, Serdang, Selangor (MY)

( * ) Notice: Subject to any disclaimer, the term of this patent is extended or adjusted under 35 U.S.C. 154(b) by 29 days.

(21) Appl. No.: 14/398,077

(22) PCT Filed: May 2, 2013

(86) PCT No.: PCT/MY2013/000091
§ 371 (c)(1),
(2) Date: Oct. 30, 2014

(87) PCT Pub. No.: WO2013/165234
PCT Pub. Date: Nov. 7, 2013

(65) Prior Publication Data

US 2015/0111285 A1 Apr. 23, 2015

(30) Foreign Application Priority Data

May 2, 2012 (MY) ..... PI 2012700251

(51) Int. Cl.

| | |
|---|---|
| ***C11D 1/66*** | (2006.01) |
| ***C11D 3/22*** | (2006.01) |
| ***C11D 3/37*** | (2006.01) |
| ***C11D 3/386*** | (2006.01) |
| ***A47L 15/44*** | (2006.01) |
| ***C11D 3/04*** | (2006.01) |
| ***C11D 3/10*** | (2006.01) |
| ***C11D 11/00*** | (2006.01) |

(52) U.S. Cl.
CPC ..... *C11D 1/662* (2013.01); *A47L 15/44* (2013.01); *C11D 1/66* (2013.01); *C11D 3/046* (2013.01); *C11D 3/10* (2013.01); *C11D 3/225* (2013.01); *C11D 3/3757* (2013.01); *C11D 3/386* (2013.01); *C11D 3/3869* (2013.01); *C11D 3/38627* (2013.01); *C11D 11/0023* (2013.01)

(58) Field of Classification Search
CPC ..... C11D 3/0015; C12N 9/98; D06F 35/006
USPC ..... 435/264
See application file for complete search history.

(56) References Cited

U.S. PATENT DOCUMENTS 5,466,389 A * 11/1995 Ilardi et al. ..... 510/175
5,593,648 A * 1/1997 Christie ..... A47L 15/4445 134/93

FOREIGN PATENT DOCUMENTS

WO WO 2011/084417 A1 7/2011
WO WO2011084417 * 7/2011 ..... C11D 3/386
WO WO2011089493 * 7/2011 ..... B08B 3/08

OTHER PUBLICATIONS

APG. Alkyl polyglucosides (APG). Cognis. 2005;1-44.*
Bhosale et al. Thermostability of high-activity alkaline protease from Conidiobolus coronatus (NCL 86.8.20). Enzyme and Microbial Technology. 1995;17:136-139.*
Cherif, Slim et al., "A newly high alkaline lipase: an ideal choice for application in detergent formulations," *Lipids in Health and Disease*, 2011, 10(221):1-8.
Hasan, Fariha et al., "Enzymes used in detergents: Lipases," *African Journal of Biotechnology*, 2010, 9(31):4836-4844.
Leow, Thean Chor et al., "High Level Expression of Thermostable Lipase from *Geobacillus* sp. Strain T1," *Biosci. Biotechnol. Biochem.*, 2004, 68(1):96-103.
Rahman, Izuddin Abdul et al., "Formulation and Evaluation of an Automatic Dishwashing Detergent Containing T1 Lipase," *Journal of Surfactants and Detergents*, 2013, 16(3):427-434.

* cited by examiner

*Primary Examiner* — Lynn Y Fan
(74) *Attorney, Agent, or Firm* — Saliwanchik, Lloyd & Eisenschenk

(57) ABSTRACT

The objective of the present invention is in the field of cleaning agent in particular detergents. In particular, it relates to a novel detergent formulation for an automatic dishwashing. The formulation provides excellent cleaning and finishing; it is environmentally friendlier than traditional compositions and allows for a more energy efficient automatic dishwashing process.

8 Claims, 3 Drawing Sheets

DETERGENT FORMULATION FOR DISHWASHING MACHINE

CROSS REFERENCE TO A RELATED APPLICATION

This application is a National Stage Application of International Application Number PCT/MY2013/000091, filed May 2, 2013; which claims priority to Malaysian Application No. PI 2012700251, filed May 2, 2012; which are both incorporated herein by reference in their entirety.

FIELD OF INVENTION

The present invention relates to a detergent formulation which is useful in a dishwasher. The inventiveness of the present invention applies by adding an enzyme in the formulation. The present invention further relates to a novel detergent formulation that is useful in automatic dishwashing machine, wherein the formulation comprises a thermostable lipase. Also, the detergent formulation provides cleaning and finishing benefits across a wide range of temperatures, improves energy profile of a dishwashing process.

BACKGROUND OF THE INVENTION

Detergents are synonymous with any chemical that cleans or get rid of stains. They have been used to remove stains since centuries ago, particularly when the most fundamental form of a detergent or surface active agents (surfactants)—soaps, were created out of ashes and fat (Levey, M. (1958) Gypsum, salt and soda in ancient Mesopotamian chemical technology. Isis. 49(3): p. 336-342.). Soaps, however, do not work in water with high level of metal ions or 'hard water' because soaps are ionic, and these imminent ionic interactions between soaps and metal ions would just deactivate soaps, and emulsification would be impossible. Considering that water quality in general is unpredictable, detergent formulations must be considered to work in most conditions.

Fortunately, modem detergents nowadays consist of complex chemicals, such as highly developed surfactants and water softeners. These surfactants are better than normal soap because they can perform better in water that is high in metal ions, especially calcium, magnesium, and iron. Many of the ingredients of modern detergents are also made from renewable raw materials, such as sugar alcohols and biodegradable polymers. The trend of shifting from petrochemical-based to oleochemical-based surfactants can be seen as the awareness on the environment and petroleum depletion rises.

In recent years there has been an ever increasing trend towards safer and environmentally friendly detergent compositions. This trend imposes additional constrains onto the dishwashing formulator. In terms of energy efficiency and raw material savings, it is desirable to design products which provide good performance even at low temperatures and with a reduction on the amount of chemicals, in particular non-readily biodegradable chemicals.

The use of enzymes in detergent formulations is becoming popular due to the concerns on the environment. It has been found to be very useful to have enzymes in dishwashing detergent compositions because enzymes are very effective in removing food soils from the surface of glasses, dishes, pots, pans and eating utensils. Björkling, F., Godtfredsen, S. E., and Kirk, O. (1991).

The future impact of industrial lipases. Trends Biotechnol. 9(1): p. 360-363 reports rapid gaining interest in enzyme use in a detergent formulation due to its biodegradability and ability to function at lower temperature. Unlike conventional detergents that get rid of stains and enter waterways, the use of enzymes could help alleviate water pollution in which the enzymes can degrade the stains and be degraded before they enter waterways. In addition, some enzymes can perform specific functions better than conventional methods involving chemicals. For example is cellulase, which can enhance fabric appearance and structure by modifying the cellulose fibers [Kuhad, R. C., Gupta, R., and Singh, A. (2011) Microbial cellulases and their industrial applications. Enzyme Res. 2011: p. 280696]. Like other detergent components, detergent enzymes are also constantly being improved; for example, a better protease [Souter, P. F. U. (2011) Automatic Dishwashing Detergent Composition. U.S. Pat. No. 8,008,241 B2] with better functionality and a better amylase [Aehle, W. and Amin, N. S. (2011) Variants of An Alpha-Amylase with Improved Production Levels in Fermentation Processes. U.S. Patent 2011/0027252 A1] with better stability. Unlike proteases and amylases, lipases have not Been extensively used in automatic dishwashing detergents but are becoming more popular, especially in reducing the amount of surfactant use.

Thus in view of the state of art cited above it is a major interest of the present invention to provide a novel detergent formulation for an automatic dishwashing machine, wherein the formulation comprising an improved enzymatic system comprising an improved lipase [preferably a thermostable lipase (T1 lipase)]. T1 lipase (E.C. 3.1.1.3) was evaluated for its stability and performance in dishwashing along with other common components of an automatic dishwashing detergent. The formulation of the invention provides cleaning and finishing benefits across a wide range of temperatures, including high temperatures, improving the energy profile of the dishwashing process. Surprisingly, the formulation of the invention allows for a more energy efficient dishwashing processes without compromising in cleaning and finishing. This invention is a new approach to simplify conventional methods in the development of a detergent formulation for an automatic dishwasher.

The T1 lipase was tested in hard water with fairly low builders, whereas other known Formulations mostly focused on high amount of builders or builders that are efficient, such as phosphates, in order to make the surfactants work. In addition, the formulation developed in the present invention is stable at high temperature, so it is suitable for automatic dishwasher, which are normally intended for high temperature washings.

The functionally of the enzyme is said to remove food soils from the surface of glasses, dishes, pots, pans and eating utensils. However, in order for the enzyme to be highly effective, the formulation must be chemically stable, and it must maintain an effective activity at the operating temperature of the automatic dishwasher.

In view of the above discussion, an objective of the present invention is to provide an eco-friendly product that at the same time provides excellent cleaning and finishing benefits.

ADVANTAGE

The present invention is in the field of cleaning agent in particular detergents. In particular, it relates to a novel detergent formulation for an automatic dishwashing comprising. The formulation provides excellent cleaning and finishing; it is environmentally friendlier than traditional compositions and allows for a more energy efficient automatic dishwashing process. The said formulation is phosphate free, therefore it will not cause the environmental pollution. To compensate the elimination of an excellent cleaning power by phosphates, the formulation includes a powerful anti-scaling agent (polyacrylate). Polyacrylate is a moderate builder, which can bind to calcites of hard water and prevent the calcite from accumulating on the cleaned surface. Together, the T1 lipase and polyacrylates, has shown synergistic effects in cleaning by supplying anions, which resuspend the soils in the solution, increasing the contact angle between the enzyme and the fatty soil.

Use

The T1 lipase enzyme binds to the ester bonds in triglycerides molecules and cuts the bonds, releasing fatty acids and glycerol. The released products that is less hydrophobic and more soluble in water. Unlike conventional non-enzymatic detergency, e.g. using surfactants, the enzyme system is less dependent on solubility and can work at wide range of temperature, including at lower than effective temperature. Although T1 lipase works optimally at elevated temperature, it has shown to work at room temperature but with reduced reaction rate. The chemical reaction, on the other hand, i.e. surfactants, depends on critical micelle concentration (CMC) and solubility to function properly.

SUMMARY OF THE INVENTION

The present invention provides a detergent formulation for dishwashing machine, wherein the formulation having the means for improving tableware or dishware cleaning, sanitizing, and/or stain removal, the said formulation is characterized in that it comprises:

Nonionic surfactant (preferably Alkyl polyglucoside) and having a working concentration between 5% and 10%; Dispersing agent (preferably sodium polyacrylate, sodium carboxymethyl cellulose (CMC), or sodium carboxymethyl inulin (CMI) and having a working concentration between 2% and 5%; Builder agent (preferably sodium or potassium carbonate and wherein the builder/pH agent having a working concentration between 3% and 10%); Enzyme stabilizer (preferably sodium citrate, glycine, or sodium bicarbonate and wherein the enzyme stabilizer having a working concentration between 7% and 20%; Enzyme which is a purified thermostable T1 lipase enzyme and the purified thermostable T1 lipase having a working concentration between 3% and 10%; Fillers(s) (preferably sodium or potassium sulfate and having a working concentration between 20% and 50%) or water.

For the present invention ,the formulation has a pH of at least 9.0 at a concentration of 1.5 grams per liter in water.

It is said that the formulation is housed in a permeable container such that it is conveniently located inside a typical automatic dishwasher without interfering with said dishwasher's normal usage; wherein said container comprises a material selected from the group consisting of glass, plastic, ceramic, metal, and combinations thereof. Also the formulation is present in the form selected from the group consisting of liquid, gel, tablet, powder, water-soluble pouch, and mixtures thereof.

Another aspect of the invention relates a method for washing tableware or dishware in dishwashing machine, comprising washing the said tableware or dishware at operating temperatures of 40° C. to 65° C. with the formulation.

DESCRIPTION OF THE DRAWINGS

The accompanied drawings constitute part of this specification and include an exemplary or preferred embodiment of the invention, which may be embodied in various forms. It should be understood, however, the disclosed preferred embodiments are merely exemplary of the invention. Therefore, the figures disclosed herein are not to be interpreted as limiting, but merely as the basis for the claims and for teaching one skilled in the art of the invention.

Error! Reference source not found.

DETAILED DESCRIPTION OF THE INVENTION

Figure 1:
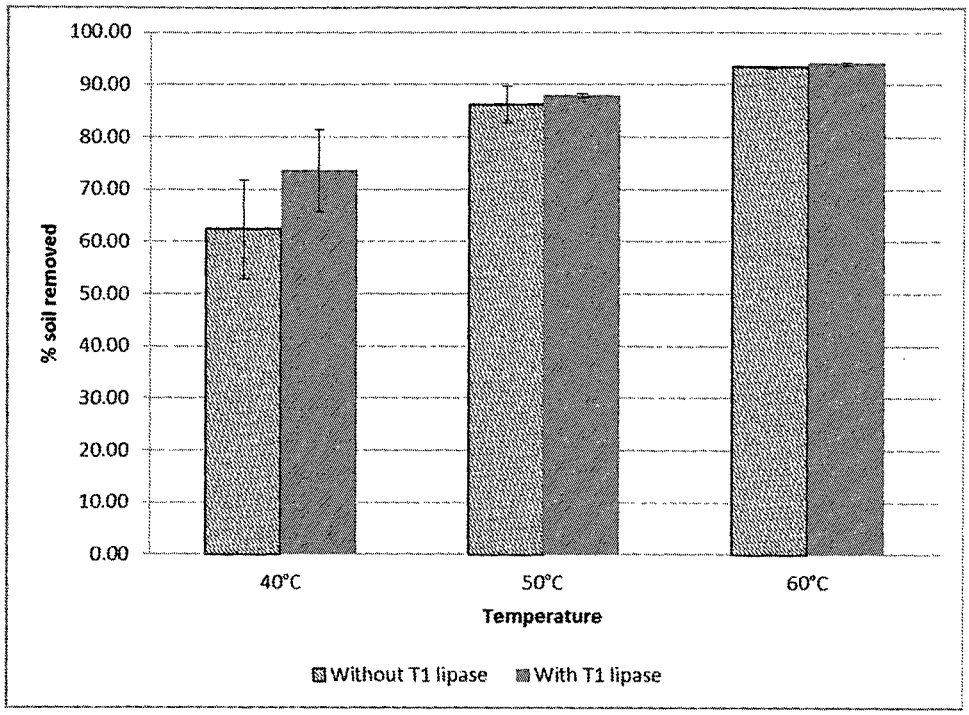
FIG. 1 shows: Dishwashing performance of detergent A containing 10% surfactant, 2.5% dispersing agent, and 50 mg T1 lipase in water of 0 ppm $CaCO_3$ (soft water) buffered with glycine-NaOH (pH 9.0) at 40° C., 50° C., and 60° C.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges, and are also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, the preferred methods and materials are now described. All publications mentioned herein are incorporated herein by reference to disclose and describe the methods and/or materials in connection with which the publications are cited. It must be noted that as used herein and in the appended claims, the singular forms "a," "an," and "the" include plural referents unless the context clearly dictates otherwise.

As used herein, the terms "detergent formulation" refer to mixtures of chemical ingredients intended for use in a wash medium for the cleaning of soiled objects. Detergent compositions/formulations generally include at least one surfactant, and may optionally include hydrolytic enzymes, oxidoreductases, builders, bleaching agents, bleach activators, bluing agents and fluorescent dyes, caking inhibitors, masking agents, enzyme activators, antioxidants, and solubilizers.

Since this research focuses on automatic dishwashing, the enzyme of interest should be able to remove the main components of food stains, i.e., proteins, carbohydrates, and fats. Preferred in the context of the present invention is further described by thermostable T1 lipase (E.C. 3.1.1.3) (which is locally (Malaysia) produced) having potential as a detergent enzyme. Like most lipases, T1 lipase cuts the insoluble triglycerides at the ester bond into glycerol and free fatty acids. It is relatively stable at temperature of 55° C. up to 80° C. and between pH 6.0 and 11.0. The wide range of working temperature makes T1 lipase suitable for detergent formulation(s), especially in automatic dishwashing where washing temperature can reach 100° C. In addition, the T1 lipase showed high activity with nonionic surfactants and many cooking oils, especially soybean and olive oil [Leow, T. C., Rahman, R. N. Z. R. A., Basri, M., and Salleh, A. B. (2007) A thermoalkaliphilic lipase of *Geobacillus* sp. T1. Extremophiles. 11(3): p. 527-535.], which were also the constituting oils of the soil (peanut butter) being used. The other main components in detergent formulation(s) such as surfactants, bleaches, alkalinity agents, and dispersing agents were also evaluated for compatibilities with T1 lipase and dishwashing performance. The T1 lipase is alkalophilic, detergent builder-stable, and has high activity. In addition, the T lipase having the means of improving its performance by the addition of calcium ions; thus, the enzyme is suitable and works well in hard water, which contains mostly calcium and magnesium ions. The presence of these ions normally prevents surfactants from performing properly; thus, the enzyme will give a synergistic effect when it is being added together with the surfactant. The surfactant helps in increasing enzyme digestion through emulsification of the fatty soil.

EXAMPLES OF CARRYING OUT THE INVENTION

While the present invention has been described with specificity in accordance with certain of its preferred embodiments, the following examples serve only to illustrate the invention and are not intended to limit the invention within the principles and scope of the broadest interpretations and equivalent configurations thereof.

Materials

All materials used in the experiments were obtained from the stated suppliers and used without any further modification. Oil Red (Sudan III) CI 26100, Polyethylene glycol 300 "PEG 300" (nonionic), polysorbate 80 (Tween 80, nonionic), sodium dodecyl sulfate "SDS" (anionic), cetyl trimethylammonium bromide "CTAB" (cationic), sodium carboxymethyl cellulose "CMC" ($M_w$=90,000 g/mol) and sodium polyacrylate "NaPA" ($M_w$=2100 g/mol) were all obtained from Sigma-Aldrich, St. Louis, Mo.; sodium carboxymethyl inulin "CMI" (Carboxyline) was obtained from Royal Cosun, Netherland; alkyl polyglucoside "APG" (Glucopon 600 CS UP, nonionic) was obtained from Henkel KgaA, Düsseldorf, Germany; APG (Triton CG-600) was obtained from Dow, Midland, Mich.; acetone, calcium chloride dihydrate, copper (II) acetate monohydrate, magnesium sulfate heptahydrate, glycine, sodium bicarbonate, sodium carbonate, sodium citrate, sodium hydroxide, sodium perborate, sodium percarbonate, and sodium tripolyphosphate were all obtained from Merck KGaA, Darmstadt, Germany; olive oil (Bertolli, Italy) and Skippy creamy peanut butter (Unilever, Malaysia) were obtained from a local supermarket; The peanut butter consisted of approximately 50% triglycerides from different sources (i.e. peanut, rapeseed, cottonseed, and soybean oil).

Methods

Enzyme Production

The T1 lipase protein was expressed in *E. coli* BL21 containing the heterologous protein from *Geobacillus zalihae* strain T1. The *E. coli* BL21 bacteria were grown in a 200 ml LB containing 35 mg/ml chloramphenicol and 50 mg/ml ampicillin at 37° C. and 200 rpm of agitation rate. The culture was then induced with 0.025 mM isopropyl β-D-thiogalactopyranosidase (IPTG) when the optical density (OD) at 600 nm of the cell culture reached 0.75. After 12 hours, the culture was centrifuged at 10,000 rpm, 4° C. for 10 min, and the pellet was kept in −80° C. freezer. The pellet was resuspended in 50 mM Glycine-NaOH buffer (pH 9.0), and the solution was sonicated (Branson, USA) for 4 min (inclusive of 30 s rest for every 30 s sonication interval). The solution was then centrifuged at 12,000×g, and the resulting supernatant containing the crude enzyme was kept in −80° C. freezer and thawed upon use.

Lipase Stability Tests

The compatibility of the T1 lipase with the other components of the formulated detergent was evaluated by incubating the enzyme in 0.2% (w/v) of those components, i.e., surfactants, bleaches, and alkalinity agents in a water bath (Protech, Malaysia) at 60° C. for 30 min. After 30 min, the enzyme was assayed for its residual activity.

Lipase Assay

The residual activity of the T1 lipase was assayed colorimetrically using a method previously described with slight modifications [Kwon, D. and Rhee, J. (1986) A simple and rapid colorimetric method for determination of free fatty acids for lipase assay. J Am Oil Chem Soc. 63(1): p. 89-92]. A cupric acetate pyridine reagent was prepared by mixing 5% (w/v) copper (II) acetate with DI water and adjusting the solution pH to 6.1 with pyridine. The substrate emulsion used consisted of olive oil/50 mM of Glycine-NaOH buffer at pH 9.0 (1:1), which was homogenized using a homogenizer (Heidolph, Germany). The reaction mixture, which consisted of 2.5 ml substrate emulsion, 0.01 ml T1 lipase (29.8 U/mg), 0.99 ml 50 mM Glycine-NaOH buffer (pH 9.0), and 20 μl 20 mM $CaCl_2$, was incubated in the same water bath at the enzyme optimum temperature of 70° C. for 30 min at 200 rpm. After 30 min, the reaction was stopped by adding 5 ml isooctane and 1 ml 6 N HCl, and the mixture was vortexed for 30 s and left for 15 min. 4 ml of the upper layer of the mixture, which contained the fatty acids, was transferred to a test tube containing 1 ml of the cupric acetate pyridine reagent, and the mixture was vortexed for 30 s and left for 1 hour. The color of the solution was then evaluated colorimetrically by reading the OD using the Ultraspec 2100 Pro spectrophotometer (Amersham Bioscience, Sweden) at 715 nm. All assays were done in triplicates. 1 unit (U) of lipase activity was defined as the rate of 1 μmol of fatty acid released per minute under standard assay conditions.

Detergent Formulation

The detergent formulation was prepared by adding components that have shown stability towards T1 lipase. The detergent formulation and their quantities were summarized below:

1. Alkyl polyglucoside (nonionic surfactant) E.g. Glucopon, Triton (5-10%)
2. Polyacrylate (dispersing agent) E.g. sodium polyacrylate, sodium carboxymethyl cellulose (CMC), or sodium carboxymethyl inuline (CMI) (2-5%)
3. Carbonate (builder/pH agent) E.g. sodium or potassium carbonate (3-10%)
4. Enzyme stabilizer E.g. sodium citrate, glycine, or sodium bicarbonate (7-20%)

5. T1 lipase (enzyme) (3-10%)
6. Water or Sulfate (filler) E.g. sodium or potassium sulfate (20-50%)

Hard Water Preparation

A stock solution of hard water was prepared by mixing 30 mM $CaCl_2.2H_2O$ and 10 mM $MgSO_4.7H_2O$ with 1 L water, which corresponded to 5000 ppm $CaCO_3$. The stock solution was then diluted and standardized to 350 ppm $CaCO_3$ by using a water hardness indicator (HI 96735 Hardness ISM, Hanna Instruments, Italy).

Dishwashing Tests

Dishwashing tests were done using the Leenert's Improved Detergency Tester (Japan) as described previously but with slight modifications [8]. Sets of microscope glass slides (6 pieces per set) were dipped for 1-2 s in a soil bath containing 20 g of peanut butter, 0.1 g of Oil Red lysochrome, and 60 ml of acetone, and dried for 2 hours. The dishwashing solutions were prepared by mixing 1.5 g of the formulated detergent solution with appropriate amount of T1 lipase (29.8 U/mg) and 1000 ml water of either 0 or 350 ppm $CaCO_3$. The dried slides were washed in the dishwashing solutions prepared previously at different temperatures (40° C., 50° C., and 60° C.) with a stirring speed of 250±10 rpm for 3 minutes. The washed slides were then rinsed with water of the same hardness for 1 minute. After rinsing, the slides were air-dried for 24 hours after which the slides were immersed in 100 ml acetone, and the OD at 518 nm of the red-colored acetone was evaluated using a spectrophotometer. The dishwashing performance was evaluated according to this formula:

$$\text{Percent soil removed}(\%) = \left[\frac{(BW - AW)}{BW}\right] \times 100$$

where BW was the OD of the red-colored acetone immersed with a set of slides that were not washed, and AW was the OD of the red-colored acetone immersed with the set of slides that were washed. All washing and reading tests were done in duplicates to ensure reproducibility.

Statistical Analysis

Statistical analyses were done using one-way ANOVA and the Turkey test at 0.05 level using the SPSS Statistics 20.0.0 (SPSS Inc., Chicago, Ill., USA).

Results and Discussions

Stability of T1 Lipase in Detergent Components

Stability of T1 lipase in various surfactants and bleaches was checked, and the results are shown in Table 1. The nonionic surfactants were mostly compatible. The interaction between nonionic surfactants and lipase is usually hydrophobic [9]; thus, the interaction might not seriously damage the protein structure. The surfactants that are made of sugar alcohol such as the Glucopon 600 CS UP (G600) and Tween 80 (T80) showed the highest stability with T1 lipase followed by PEG 300 (Table 1). One study showed that the protective effect of polyhydric or sugar alcohol improved lipase stability regardless of the nature of the sugar alcohol [10]. Another study also showed that the addition of a sugar alcohol, sorbitol showed improved lipase stability compared to incubating in ethylene glycol alone [11]. These results showed that sugar alcohol improved the stability of lipases, especially at elevated temperature.

Table 2 also shows that T1 lipase was not compatible with ionic surfactants. Although anionic bile salt helps in lipid digestion in human intestines [12], the anionic sodium dodecyl sulfate (SDS), which is a popular choice of surfactant in detergent formulations, destabilized T1 lipase (Table 1). SDS is generally known to denature proteins by binding to the protein backbone and unfolding the native structure, and it is common for lipases to be denatured by SDS. However, the combination of nonionic and anionic surfactants has shown to prevent enzyme denaturation. Table 1 showed that the combination of the nonionic G600 and anionic SDS prevented further denaturation of T1 lipase. This method has been used not only for the stability of enzymes in formulation but also for overall cleaning in which some studies have shown better cleaning when two surfactant systems were mixed [13]. The cationic CTAB strongly destabilized T1 lipase because the enzyme has a slight negative charge [6]. Consequently, T1 lipase might have precipitated and lost its functionality. The stability and improvement of enzymes by surfactants therefore vary depending on the enzyme and its characteristics [9].

Perborates and percarbonates strongly destabilized T1 lipase (Table 1) albeit being mild bleaching/oxidizing agents. It is generally known that enzymes are susceptible to denaturation by bleaching agents unless they are genetically engineered to be more resistant to bleaching agents. Proteases such as Durazym and Purafect are two examples of proteases that are genetically engineered using site-directed mutagenesis to improve their stability with bleaching agents [14]. This implied that T1 lipase could also be genetically modified to be stable with bleaching agents. Bleaches are essential because some stains such as tea and coffee stains cannot be easily removed by surfactants and unless specific enzymes that can break down these polyaromatic compounds are employed as well.

Stability of T1 lipase in various alkalinity agents was also checked, and the relative activities and resulting pH of the alkalinity agents in solutions were summarized in Table 1.

TABLE 1

Stability of T1 lipase in various surfactants and bleaches

| Surfactant or bleach | Relative activity (%) |
|---|---|
| PEG 300 (nonionic) | 61 |
| G600 (nonionic) | 136 |
| Tween 80 (nonionic) | 98 |
| SDS (anionic) | 14 |
| SDS/G600 (1:1) | 43 |
| CTAB (cationic) | 1.9 |
| Sodium perborate | 3.4 |
| Sodium percarbonate | 0.3 |
| w/o (control) | 100 |

Most of the alkalinity agents also bind to cations to reduce water hardness. Sodium carbonate (SC) and sodium tripolyphosphate (STPP) gave good pHs but showed the lowest residual activities. This might be due to the binding of SC and STPP to $Ca^{2+}$ that were essential to T1 lipase in maintaining its structural stability. This occurrence was shown in a study whereby both SC and STPP bound to $Ca^{2+}$, producing $CaCO_3$ precipitates and $Ca_3(PO_4)_2$, respectively [15]. On the other hand, sodium citrate, which was also proven to be a good metal chelator, did not greatly affect the stability of T1 lipase compared to that of SC and STPP (Table 2). Sodium citrate had a binding constant 1-3 orders lower than that of enzymes [16], which might explain why the stability of T1 lipase was not greatly affected. Since sodium citrate has a low pKa, it could only be used as an auxiliary component with other mild builders in a detergent formulation.

Since T1 lipase has an optimum pH of 9.0 and stable in between pH 6.0 and 11.0 [6], carbonate and bicarbonate were chosen due to their high pKa values. However, the buffering capacity of bicarbonate is only moderate, and T1 lipase was greatly destabilized by carbonate. Fortunately, a combination of carbonate/glycine at a ratio of 30:70 in an aqueous solution, which gave a resulting pH of 9.25 (close to the T1 lipase optimum pH at pH 9.0), showed high enzymatic stability (Table 2). This might indicate that glycine has a stabilizing effect on T1 lipase, compensating the effect of the reduction of $Ca^{2+}$.

TABLE 2

Stability of T1 lipase in various alkalinity agents

| Alkalinity agents | Relative activity (%) | pH |
|---|---|---|
| Sodium carbonate (SC) | 1 | 10.84 |
| SC:glycine (30:70) | 129 | 9.25 |
| Sodium bicarbonate (SB) | 94 | 8.63 |
| SC:SB (30:70) | 0 | 9.50 |
| Sodium citrate | 48 | 8.30 |
| Sodium tripolyphosphate | 0 | 9.60 |
| Glycine-NaOH (control) | 100 | 9.00 |

Dishwashing Performance

Dishwashing performance was evaluated in term of percent soil removed.

The dishwashing performance of detergent A in ion-free water at various temperatures is shown in FIG. 1. As expected, the dishwashing performance improved as the temperature increased. At 0 ppm of $CaCO_3$, a full detergency was almost achievable without the help of T1 lipase. The improvement after adding T1 lipase also became smaller after each increment in temperature, showing that elevated temperature lowered surface tension of water and promoted better soil removal. In addition, the dishwashing performance of the formulated detergent was quickly observable in the absence of ionic interference, especially at 60° C. where 50% of soil removal was observed within half of the duration of the test.

Figure 2:
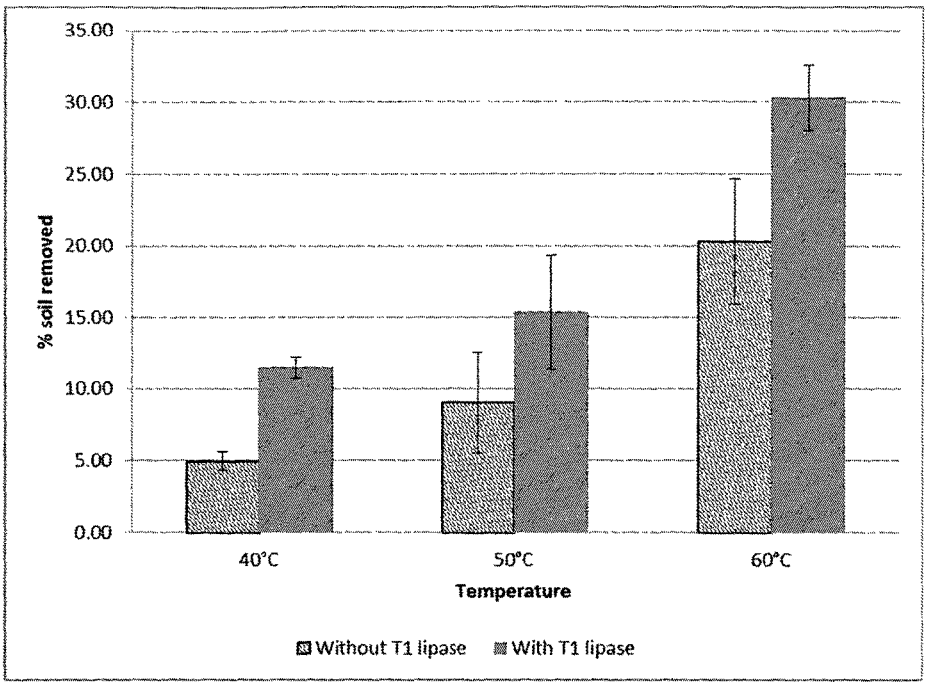
FIG. 2 shows: Dishwashing performance of detergent B containing 10% surfactant, 2.5% dispersing agent, and 50 mg T1 lipase in hard water of 350 ppm $CaCO_3$ buffered with glycine-NaOH (pH 9.0) at 40° C., 50° C., and 60° C.

FIG. 2 compares the dishwashing performance of detergent B in hard water of 350 ppm $CaCO_3$ at various temperatures. Similar to the previous results, the dishwashing performance improved as the temperature increased but not as much as that in water of 0 ppm $CaCO_3$. The performance of the nonionic surfactant was severely affected by the high amount of $Ca^{2+}$ and $Mg^{2+}$ presence in the water. This might be due to the formation of a highly charged structure made of the surfactant and ions, which prevented the removal of soil from the hard surface [13].

Although nonionic surfactants (i.e. ethoxylates) are mostly insensitive to hard water, alkyl polyglucosides (APG) are different as they are made of sugar alcohols. A study showed that unlike ethoxylates, which are mostly uncharged, APG micelles are negatively charged [17]. This might explain the severe performance deterioration of APG in the presence of electrolytes, specifically cationic electrolytes.

FIG. 2 also shows that the improvements in dishwashing performance by the addition of T1 lipase were more apparent in hard water because the enzyme was not negatively affected by the $Ca^{2+}$ and $Mg^{2+}$ presence in the water [6]. The improvement after adding T1 lipase was also more dramatic at 60° C. as the crude T1 lipase reached its optimum temperature. The purified T1 lipase has an optimum temperature of 70° C., and relative activities of 50% and 75% at 50° C. and 60° C., respectively [6]. At higher temperature, the active site of T1 lipase might become more exposed; thus, giving higher activity.

Figure 3:
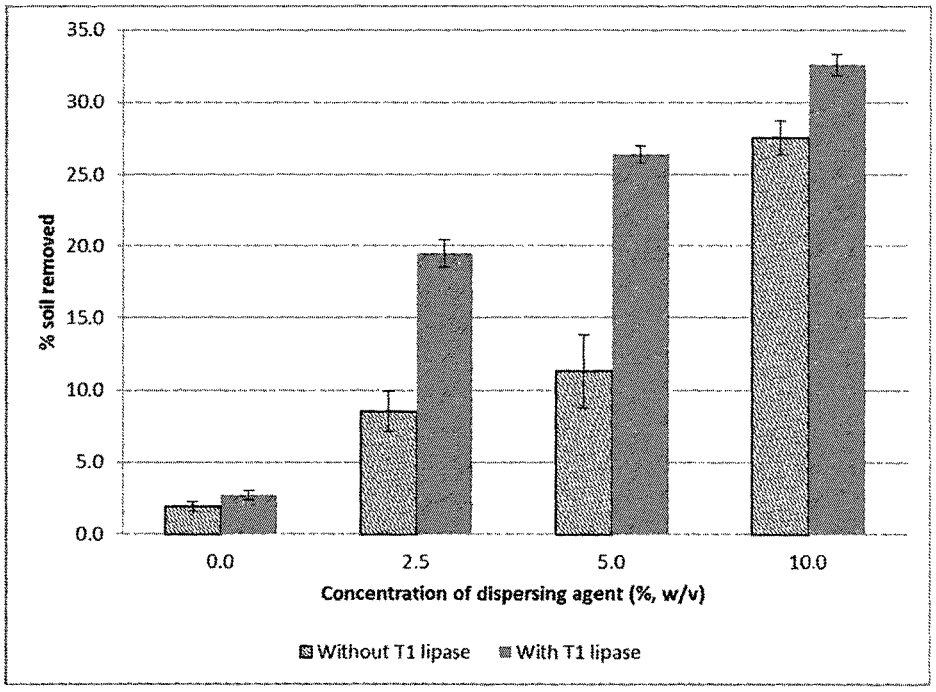
FIG. 3 shows Dishwashing performance of detergent C containing 10% surfactant, 50 mg T1 lipase, and 0-10% dispersing agent in hard water of 350 ppm at $CaCO_3$ buffered with glycine-NaOH (pH 9.0) at 50° C.

FIG. 3 compares the dishwashing performance of detergent C in hard water of 350 ppm $CaCO_3$ at 50° C. with increasing concentration of dispersing agent. Polyacrylate polymer is an excellent dispersing agent with mild chelating power and can reduce the effect of hard water by inhibiting calcium carbonate crystal formation. The effect of polyacrylate polymer can be seen in the improvement of dishwashing performance, especially when the concentration of dispersing agent was increased (with or without adding T1 lipase) (FIG. 3). However, better improvements were seen when dispersing agent and T1 lipase were combined. The improvements in detergency could be due to the synergistic effect between the dispersant and T1 lipase. Polyacrylates increased the negative charges in the solution, increasing the repulsive forces between the polymer and soil, and preventing redeposition of soil back to the hard surface. This may allow more soil to disperse into the bulk phase, exposing and increasing the surface area of the substrate for T1 lipase digestion.

The increase in negative charges had also shown to increase lipase activity through another mechanism. In one study, polyelectrolyte complex micelles consisting of Lipolase (a lipase), a negatively charged polyacrylate polymer with molecular weight of 10,000 g/mol, and a positively charged copolymer showed higher activity than the free lipase [18]. This finding inferred that the negative charges from the polymer led to an open confirmation of the lipase; thus, increasing the activity of the lipase, which would otherwise be in a closed confirmation in the bulk. The activity of lipase is also generally known to increase when it is activated whereby its lid is in the open confirmation, which occurs at the oil/water interface.

FIG. 3 also shows that at the highest concentration of polyacrylates (10%), the dishwashing performance was not significantly improved by the addition of T1 lipase. This might be due to the reduction of hard water by polyacrylates, improving the functionality of the surfactant. A study showed that hard water reduction was achieved through adsorption of the polyacrylates to the calcium carbonate surface [19]. This study showed that polyacrylates with lower molecular weight (2000-5000 g/mol) were shown to be better at adsorbing compared to those of higher than 5000 g/mol in which precipitation would occur instead of adsorption. This study also showed that precipitation would reduce the amount of polyacrylates available in the solution.

Besides reducing hard water, polyacrylates had also shown to reduce water spot formation due to precipitation of calcium and carbonates. This reduction was achieved due to reduction of calcium carbonate by the polyacrylates through inhibition of crystal formations. One study showed that polyacrylates with molecular weight between 2100 and 240,000 g/mol were shown to be effective in dispersing a large soil into smaller fragments [20]. In addition, the dispensability would not only inhibit the crystal formations but also reduce redeposition of soil back to the cleaned surface.

After the formulated detergent and T1 lipase had been evaluated for dishwashing performance in hard water, they were tested in the presence of water softening agents, i.e. sodium carbonate, while maintaining the T1 lipase stability using glycine in the ratio previously mentioned. This stabilizing system served as a substitute for the glycine-NaOH buffer (pH 9.0). Glycine-NaOH buffer was effective only at certain concentration and thus was deemed not applicable for dishwashing.

Figure 4:
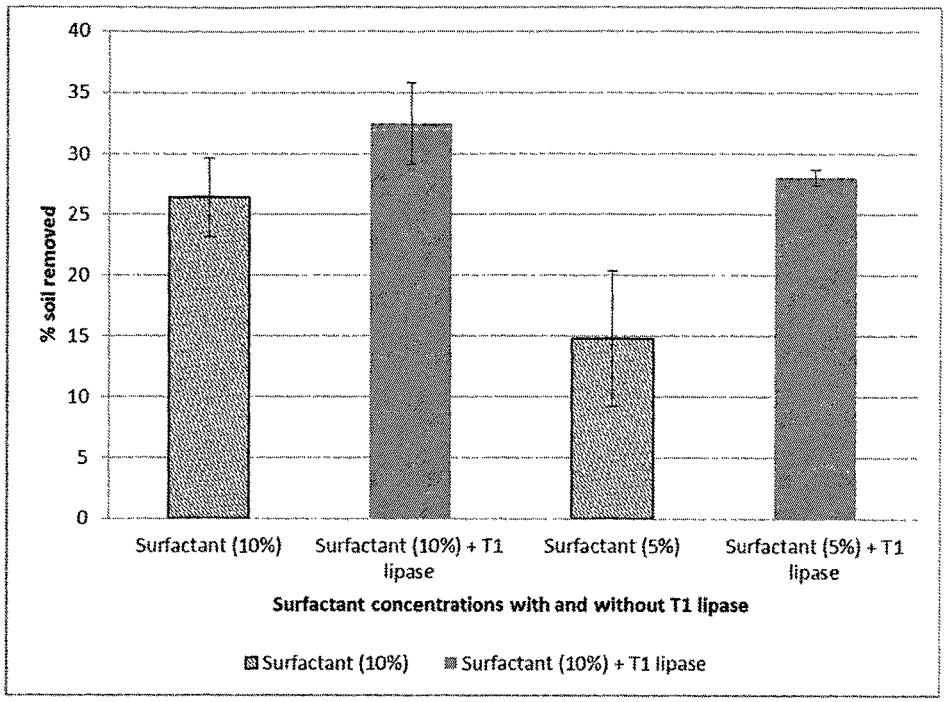
FIG. 4 shows Dishwashing performance of detergent D containing 5-10% surfactant, 2.5% dispersing agent, 10% alkalinity agent, and 50 mg T1 lipase in hard water of 350 ppm $CaCO_3$ at 60° C.

FIG. 4 shows the dishwashing performance of detergent D in hard water of 350 ppm $CaCO_3$ at 60° C. Sodium carbonate improved dishwashing performance of the detergent D (10% surfactant) by approximately 7% and 2% without and with T1 lipase, respectively (FIGS. 2 and 4). This showed that sodium carbonate might have reduced the hard water and slightly improved the surfactant functionality, while T1 lipase did not show any significant improvement.

FIG. 4 also shows that the dishwashing performance decreased by almost 50% when the surfactant was reduced by 50% and T1 lipase was removed. However, the dishwashing performance of the halved concentrated surfactant was higher when T1 lipase was added compared to the performance of the halved concentrated surfactant alone. This proved again that T1 lipase was not negatively affected by the presence of $Ca^{2+}$ and $Mg^{2+}$ in the water, while the surfactant was. This could also be explained by the high efficiency of an enzyme system compared to a surfactant system, which the later depends on critical micelle concentration (CMC) and solubility to work efficiently.

Figure 5:
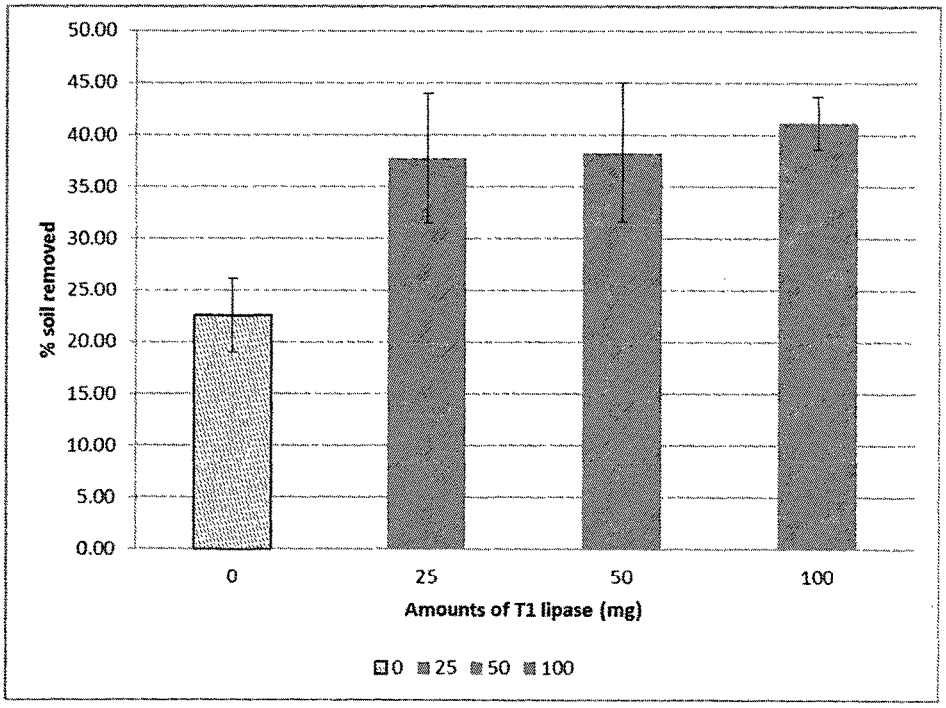
FIG. 5 shows Dishwashing performance of detergent E containing 10% surfactant, 2.5% dispersing agent, 10% alkalinity agent, and 0-100 mg of T1 lipase in hard water of 350 $CaCO_3$ at 60° C.

While surfactant concentration showed an important aspect in dishwashing, it is interesting to see whether the amount of T1 lipase played an important role in dishwashing performance. FIG. 5 compares the dishwashing performance of detergent E with different amount of added T1 lipase in hard water of $CaCO_3$ at 60° C. The results show that adding T1 lipase almost doubled the dishwashing performance; however, adding more T1 lipase did not substantially improve the performance (FIG. 5). All results showed significant mean differences at the 0.05 level, using the Turkey test.

In addition, the maximum dishwashing performance of the formulated detergent containing T1 lipase in hard water was slightly above 40%. This could be explained by the nature of the soil, which consisted of fat, protein, and carbohydrate. Since T1 lipase only break down fats, it is also important to consider other enzymes that can break down proteins and carbohydrates.

These dishwashing results may suggest that a substantial increase in dishwashing performance could be achieved by adding other enzymes that are compatible with T1 lipase and the other components, and which could become auxiliary components, especially in this case where the surfactant and T1 lipase showed synergistic effect in dishwashing performance in the presence of ionic interferences.

The performance of surfactants can be negatively affected by the presence of metal ions. Most ADD aims at reducing metal ion interferences during washing by incorporating chelating/complexing agents or builders, such as sodium tripolyphosphate (STPP), sodium silicates, sodium citrates, sodium carbonates, and zeolites. The chelating agents bind to metal ions, allowing the surfactant to perform effectively. However, it is well known that enzymes work well with metal ions, so our approach is to incorporate an enzyme into the formulation. STPP has been by far the best builder except that it is no longer allowed in modern formulations. Sodium carbonate has thus been widely used because of its cheap cost. Other formulations contains new, patented chemicals that work almost as good as STPP, such as carboxymethyl inuline (CMI) and different versions of polyacrylates.

Preferred in this respect is that the new formulation of this present invention contains polyacrylates, which prevent calcite formations and disperse soils, and an enzyme that is able to digest the soil even in hard water.

Table 4 to 6 represents temperature improved detergency. Hard water reduced detergency. Adding T1 improved detergency

TABLE 4

| | Cleanliness (%) | | | |
|---|---|---|---|---|
| | 0 ppm | | 350 ppm | |
| | (−T1) | (+T1) | (−T1) | (+T1) |
| 40 | 0.3764 | 0.3884 | 1.1610 | 1.0828 |
| 40 | 0.5398 | 0.2543 | 1.1500 | 1.0700 |
| 50 | 0.1987 | 0.1432 | 1.1360 | 0.9949 |
| 50 | 0.1374 | 0.1504 | 1.0757 | 1.0632 |
| 60 | 0.0835 | 0.0705 | 1.0060 | 0.8663 |
| 60 | 0.0800 | 0.0750 | 0.9311 | 0.8273 |

TABLE 5

| | Cleanliness (%) | | | |
|---|---|---|---|---|
| | 0 ppm | | 350 ppm | |
| | (−T1) | (+T1) | (−T1) | (+T1) |
| 40 | 69.03 | 68.04 | 4.48 | 10.91 |
| 40 | 55.59 | 79.08 | 5.38 | 11.96 |
| 50 | 83.65 | 88.22 | 6.53 | 18.14 |
| 50 | 88.70 | 87.63 | 11.50 | 12.53 |
| 60 | 93.13 | 94.20 | 17.23 | 28.72 |
| 60 | 93.42 | 93.83 | 23.39 | 31.94 |

TABLE 6

| | Cleanliness (%) | | | | | | | |
|---|---|---|---|---|---|---|---|---|
| | 0 PPM | | | | 350 PPM | | | |
| | Average | | Stdev | | Average | | Stdev | |
| | (−T1) | (+T1) | (−T1) | (+T1) | (−T1) | (+T1) | (−T1) | (+T1) |
| 40 | 62.31 | 73.56 | 9.51 | 7.801795 | 4.93 | 11.44 | 0.64 | 0.74469 |
| 50 | 86.17 | 87.92 | 3.57 | 0.418888 | 9.01 | 15.33 | 3.51 | 3.970712 |
| 60 | 93.27 | 94.01 | 0.20 | 0.261805 | 20.31 | 30.33 | 4.36 | 2.271887 |

Table 7 represents the dispersing agent effect

| Concentrations | | Read 1 | Read 2 | ReadAve | Clean 1 | Clean 2 | CleanAve | Stdev |
|---|---|---|---|---|---|---|---|---|
| 0.0 | (−T1) | 1.2000 | 1.1900 | 1.1950 | 1.7 | 2.1 | 1.9 | 0.290895 |
| | (+T1) | 1.1915 | 1.1800 | 1.1858 | 2.4 | 2.9 | 2.7 | 0.334529 |
| 2.5 | (−T1) | 1.1477 | 1.1000 | 1.1239 | 7.5 | 9.5 | 8.5 | 1.387568 |
| | (+T1) | 1.0034 | 0.9700 | 0.9867 | 18.8 | 20.2 | 19.5 | 0.971588 |
| 5.0 | (−T1) | 1.0123 | 1.1000 | 1.0562 | 13.1 | 9.5 | 11.3 | 2.551146 |
| | (+T1) | 0.8791 | 0.9000 | 0.8896 | 26.8 | 26.0 | 26.4 | 0.60797 |

-continued

| Concentrations | | Read 1 | Read 2 | ReadAve | Clean 1 | Clean 2 | CleanAve | Stdev |
|---|---|---|---|---|---|---|---|---|
| 10.0 | (−T1) | 1.5340 | 1.5000 | 1.5170 | 26.7 | 28.3 | 27.5 | 1.148614 |
| | (+T1) | 1.4218 | 1.4000 | 1.4109 | 32.1 | 33.1 | 32.6 | 0.736464 |

Table 8 represents the surfactant concentration effect

| | Read 1 | Read 2 | ReadAve | Clean 1 | Clean 2 | cleanave | stdev |
|---|---|---|---|---|---|---|---|
| D | 0.9674 | 0.9090 | 0.9382 | 24.12 | 28.70 | 26.41 | 3.24 |
| D + E | 0.8910 | 0.8304 | 0.8607 | 30.11 | 34.87 | 32.49 | 3.36 |
| D/2 | 1.1365 | 1.0359 | 1.0862 | 10.86 | 18.75 | 14.80 | 5.58 |
| D/2 + E | 0.9223 | 0.9108 | 0.9166 | 27.66 | 28.56 | 28.11 | 0.64 |

| | Enzyme (mg/L): | | | |
|---|---|---|---|---|
| | 0 | 25 | 50 | 100 |
| Read 1 | 1.3134 | 0.7523 | 0.9357 | 0.7795 |
| Read 2 | 1.2297 | 1.0941 | 1.0904 | 0.9971 |
| Read 3 | | | | 0.7286 |
| Clean 1 | 20.00 | 42.18 | 43.00 | 40.09 |
| Clean 2 | 25.09 | 33.35 | 33.58 | 39.26 |
| Clean 3 | | | | 44.00 |
| AveRead | 22.55 | 37.77 | 38.29 | 41.12 |
| AveClean | 22.55 | 37.77 | 38.29 | 41.12 |
| Stdev | 3.600145 | 6.242399 | 6.663069 | 2.531287 |

Table 9 represents the effect of enzyme

The invention claimed is:

1. A detergent formulation for a dishwashing machine, wherein the formulation improves tableware or dishware cleaning, sanitizing, and/or stain removal, and said formulation comprises:

a. a nonionic surfactant, wherein the nonionic surfactant is an alkyl polyglucoside having a concentration between 5% and 10% by weight, b. a dispersing agent that is sodium polyacrylate, sodium carboxymethyl cellulose (CMC), or sodium carboxymethyl inulin (CMI), wherein the dispersing agent has a concentration between 2% and 5% by weight, c. a builder agent, wherein the builder agent is carbonate and has a concentration between 3% and 10% by weight, d. an enzyme stabilizer that is glycine, wherein the enzyme stabilizer has a concentration between 7% and 20% by weight, e. an enzyme, wherein the enzyme is a purified thermostable T1 lipase enzyme stable at temperatures between 55° C. and 80° C., f. a filler that is sodium or potassium sulfate, wherein the filler has a concentration between 20% and 50% by weight, and g. water, wherein carbonate and glycine are present at a ratio of 30:70, and wherein the formulation has a pH of at least 9.0 at a concentration of 1.5 grams per liter in water.

2. The formulation according to claim 1, wherein the builder agent comprises sodium or potassium carbonate.

3. The formulation according to claim 1, wherein the purified thermostable T1 lipase enzyme has a concentration between 3% and 10% by weight.

4. The formulation according to claim 1, wherein said formulation is housed in a permeable container such that it can be placed inside an automatic dishwasher without interfering with said dishwasher's normal usage; and wherein said container comprises a material selected from the group consisting of glass, plastic, ceramic, metal, and combinations thereof.

5. The formulation according to claim 1, wherein said formulation is in a form selected from the group consisting of liquid, gel, tablet, powder, water-soluble pouch, and mixtures thereof.

6. A method for washing tableware or dishware in a dishwashing machine, comprising washing the said tableware or dishware at an operating temperature of 40° C. to 65° C. with the formulation as defined in claim 1.

7. The formulation according to claim 1, further comprising one or more enzymes for the breakdown of proteins and/or carbohydrates.

8. The formulation according to claim 1, wherein the formulation has a pH of 9.25.

* * * * *